US011198206B2

(12) United States Patent
Queck et al.

(10) Patent No.: US 11,198,206 B2
(45) **Date of Patent: *Dec. 14, 2021**

(54) AUTOMATED SEAMING APPARATUS AND METHOD

(71) Applicant: Cardinal IG Company, Eden Prairie, MN (US)

(72) Inventors: Curt L. Queck, Spring Green, WI (US); Michael J. Milewski, Poynette, WI (US); Robert C. Buchanan, Spring Green, WI (US); Erik W. Carlson, Spring Green, WI (US); Jonathan D. Wyman, Spring Green, WI (US)

(73) Assignee: CARDINAL IG COMPANY, Eden Prairie, MN (US)

( * ) Notice: Subject to any disclaimer, the term of this patent is extended or adjusted under 35 U.S.C. 154(b) by 355 days.

This patent is subject to a terminal disclaimer.

(21) Appl. No.: 15/935,364

(22) Filed: Mar. 26, 2018

(65) Prior Publication Data

US 2018/0207765 A1 Jul. 26, 2018

Related U.S. Application Data

(63) Continuation of application No. 14/688,577, filed on Apr. 16, 2015, now Pat. No. 9,925,634.

(51) Int. Cl.

| | |
|---|---|
| ***B24B 9/10*** | (2006.01) |
| ***B24B 49/12*** | (2006.01) |
| ***B24B 51/00*** | (2006.01) |

(52) U.S. Cl.

CPC ..... *B24B 9/10* (2013.01); *B24B 49/12* (2013.01); *B24B 51/00* (2013.01)

(58) Field of Classification Search

CPC ..... B24B 9/10; B24B 49/12; B24B 51/00; B24B 9/102; B24B 9/107

USPC ..... 451/260, 261; 700/164

See application file for complete search history.

(56) References Cited

U.S. PATENT DOCUMENTS

| | | | | |
|---|---|---|---|---|
| 2,049,850 A | | 8/1936 | Lytle et al. | |
| 2,637,951 A | * | 5/1953 | White | B24B 9/102 451/302 |
| 2,837,876 A | | 6/1958 | Kocher | |
| 2,966,013 A | * | 12/1960 | Hanneken | B24B 9/102 451/188 |
| 3,279,664 A | * | 10/1966 | Lynch | B65G 49/068 225/96.5 |

(Continued)

FOREIGN PATENT DOCUMENTS

| | | |
|---|---|---|
| CN | 208979868 U | 6/2019 |
| CN | 208979869 U | 6/2019 |

(Continued)

OTHER PUBLICATIONS

Factory layout of SeamMaXX Pro and ShapeSeam Pro lines, Ashton Industrial, dated Jan. 10, 2013 at 11:25 AM, 3 pages.

(Continued)

*Primary Examiner* — Joel D Crandall

(74) *Attorney, Agent, or Firm* — Fredrikson & Byron, P.A.

(57) ABSTRACT

A seaming station and method of seaming utilizing two robot arms with seaming heads coupled thereto to seam a large lite by working in conjunction with one another or simultaneously seaming two lites independently of one another.

17 Claims, 12 Drawing Sheets

(56) References Cited

U.S. PATENT DOCUMENTS

| | | | | |
|---|---|---|---|---|
| 3,570,186 | A | 3/1971 | Kulwicki | |
| 3,800,477 | A | 4/1974 | Mc Kelvey et al. | |
| RE28,609 | E | 11/1975 | Malburet | |
| 3,932,962 | A | 1/1976 | Devillers | |
| 4,060,937 | A | 12/1977 | Glazer | |
| 4,200,420 | A | 4/1980 | Cathers et al. | |
| 4,228,886 | A | 10/1980 | Moran | |
| 4,228,993 | A | 10/1980 | Cathers | |
| 4,375,141 | A | 3/1983 | Gaetano | |
| 4,426,811 | A | 1/1984 | Eckardt et al. | |
| 4,437,268 | A | 3/1984 | Righetti | |
| 4,559,001 | A * | 12/1985 | Wiedenhofer | E06B 3/67365 425/114 |
| 4,623,296 | A | 11/1986 | McGuire et al. | |
| 4,658,550 | A * | 4/1987 | Myers | B24B 9/102 451/184 |
| 4,739,590 | A | 4/1988 | Myers et al. | |
| 4,770,120 | A | 9/1988 | Komatsu et al. | |
| 4,846,625 | A | 7/1989 | Gabillet | |
| 5,005,318 | A * | 4/1991 | Shafir | B24B 9/10 451/239 |
| 5,030,059 | A | 7/1991 | Favre | |
| 5,330,311 | A | 7/1994 | Cawley et al. | |
| 5,620,293 | A | 4/1997 | Alarcon-Lopez et al. | |
| 5,632,590 | A | 5/1997 | Pearson et al. | |
| 5,700,128 | A | 12/1997 | Tonnigs et al. | |
| 6,416,382 | B1 | 7/2002 | Bavelloni | |
| 6,428,390 | B1 | 8/2002 | Clark et al. | |
| 6,659,265 | B2 | 12/2003 | Pfeilschifter et al. | |
| 6,685,541 | B2 | 2/2004 | Brown et al. | |
| 6,796,886 | B2 | 9/2004 | Bushell | |
| 6,807,461 | B2 | 10/2004 | Kneifel, II et al. | |
| 6,898,833 | B2 | 5/2005 | Ashton | |
| 6,976,574 | B2 | 12/2005 | Franz | |
| 7,001,249 | B1 | 2/2006 | Pride et al. | |
| 7,056,191 | B2 | 6/2006 | Takatsuji et al. | |
| 7,094,128 | B2 | 8/2006 | Vianello et al. | |
| 7,140,953 | B1 | 11/2006 | Raynauld | |
| 7,275,979 | B2 | 10/2007 | Raynauld | |
| 7,771,248 | B2 | 8/2010 | Vianello et al. | |
| 8,210,339 | B2 | 7/2012 | Strass | |
| 8,231,431 | B2 | 7/2012 | Gajaria et al. | |
| 8,276,960 | B2 | 10/2012 | Franz et al. | |
| 8,282,443 | B2 | 10/2012 | Vianello et al. | |
| 8,449,348 | B2 | 5/2013 | Sondag | |
| 8,540,551 | B2 | 9/2013 | Brown et al. | |
| 8,590,688 | B2 | 11/2013 | Weigl | |
| 8,757,355 | B2 | 6/2014 | Weigl | |
| 8,788,086 | B2 | 7/2014 | Franz | |
| 9,718,629 | B2 | 8/2017 | Wenninger et al. | |
| 10,377,583 | B2 | 8/2019 | Strass | |
| 2002/0046919 | A1 | 4/2002 | Gariglio | |
| 2002/0061712 | A1 | 5/2002 | Gariglio | |
| 2002/0180142 | A1 | 12/2002 | Sisk | |
| 2003/0118436 | A1 | 6/2003 | Kameda et al. | |
| 2004/0007020 | A1 * | 1/2004 | Kanno | C03B 23/0254 65/29.11 |
| 2004/0240981 | A1 | 12/2004 | Dothan et al. | |
| 2005/0032460 | A1 * | 2/2005 | Takatsuji | B25J 9/1664 451/5 |
| 2006/0099064 | A1 | 5/2006 | Anaki et al. | |
| 2012/0207575 | A1 | 8/2012 | Masoero et al. | |
| 2013/0116822 | A1 * | 5/2013 | Atohira | G05B 19/4097 700/255 |
| 2015/0005923 | A1 * | 1/2015 | Gu | B25J 9/1697 700/164 |
| 2015/0259159 | A1 | 9/2015 | Herfert | |
| 2015/0274420 | A1 | 10/2015 | Krommer | |
| 2015/0274440 | A1 | 10/2015 | Strass | |

FOREIGN PATENT DOCUMENTS

| | | | | |
|---|---|---|---|---|
| DE | 4419963 | C1 * | 9/1995 | B24B 21/002 |
| DE | 202012010085 | U1 | 1/2013 | |
| DE | 102014017968 | A1 | 4/2016 | |
| EP | 1101743 | A2 | 5/2001 | |
| EP | 1473261 | A1 | 11/2004 | |
| EP | 3450362 | A1 | 3/2019 | |
| JP | 61079559 | A * | 4/1986 | |
| JP | 2001139138 | A | 5/2001 | |
| JP | 2001180822 | A | 7/2001 | |
| WO | 2018233741 | A1 | 12/2018 | |

OTHER PUBLICATIONS

Factory layout of SeamMaXX Pro and ShapeSeam Pro lines, Ashton Industrial, dated Jan. 10, 2013 at 7:41 AM, 3 pages.

"Mobile Robot Work Cells," Robotics Bible, Dec. 14, 2011, Retrieved online from <http://www.roboticsbible.com/mobile-robot-work-cells.html>, 5 pages.

Offer for ShapeSeam-Pro from Ashton Industrial, dated Aug. 27, 2012, 10 pages.

Pretempering Machinery, Ashton Industrial Sales, retrieved from internet on Oct. 8, 2014, from http://www.ashton-industrial.com/?page_id=1329, 1 page.

Seammaxx-Pro, Ashton Industrial Sales, retrieved from the internet on Oct. 8, 2014, from http://www.ashton-industrial.com/?page_id=80, 2 pages.

Shapeseam-Pro, Ashton Industrial Sales, retrieved from the internet on Oct. 8, 2014, from http://www ashton-industrial.com/?page_id=1931, 5 pages.

Waurzyniak, "Automating with Vision," Manufacturing Engineering, Nov. 1, 2007, Retrieved online from <http://sme.org/MEMagazine/Article.aspx?id=20205&taxid=1460>, 4 pages.

"129—(N)—Destacker Double Head + Transfer," NORDA S.p.A., retrieved from the Internet from https://www.youtube.com/watch?v=dYK9cxXXJ60, published Aug. 22, 2012, 1 page.

"Ashton Industrial RoboLoad Pro," Ashton Industrial, Retrieved online from <https://www.youtube.com/watch?time_continue=383&v=tXWmjG2UyeQ&feature=emb_title>, published Jul. 26, 2011, 1 page.

"Grenzebach Tin Air Speed Stacker TASS with Siemens inside," Siemens, retrieved from the Internet from https://www.youtube.com/watch?v=DcSoxPBWvOA, published Oct. 22, 2018, 1 page.

"Roboload-Pro™ Automatic Loading & Unloading Systems," Ashton Industrial, Retrieved online from <http://www.ashton-industrial.com/?page_id=19> on Apr. 23, 2020, and believed to be publicly available more than one year prior to the filing date of the instant application, 2 pages.

"Robot Handling Equipment," Ashton Industrial, Retrieved online from <http://www.ashton-industrial.com/?page_id=2884> on Aug. 27, 2020, and believed to be publicly available more than one year prior to the filing date of the instant application, 1 page.

"Why ATI Tool Changers?" ATI Industrial Automation, retrieved online from <https://www.youtube.com/watch?time_continue=38&v=kDP-oofDn4w&feature=emb_title&app=desktop>, published Feb. 5, 2016, 2 pages.

* cited by examiner

AUTOMATED SEAMING APPARATUS AND METHOD

RELATED APPLICATIONS

This is a continuation of application Ser. No. 14/688,577, filed Apr. 16, 2015, the contents of which are incorporated herein by reference.

TECHNICAL FIELD

The present invention relates in general to the glass manufacturing field and, in particular, to an automated glass seaming system and a method for seaming edges of glass sheets.

BACKGROUND

Sheet glass manufacturing generally requires three steps; melting of raw material, forming the melted glass into the proper shape, i.e., glass sheets otherwise known as lites, and finally shaping the glass sheets into a final shape which is satisfactory for the user of the glass sheets. The final shaping step includes edging, or seaming, the glass sheets to strengthen the glass sheets and make the glass sheet more manageable for handling operations. Seaming a glass sheet, otherwise known as arissing, involves removing the sharp edges of glass sheets by grinding them away. Seaming the glass sheet makes it less dangerous to handle and also reduces the number of microcracks formed if the glass sheet is later tempered. The discussion herein relates to the process of seaming of glass sheets.

Glass sheet seaming is typically done one glass sheet or lite at a time by utilizing a grinding wheel which has groove(s) formed therein. The formed groove(s) create a shape on the edge of the glass sheet that mirrors the groove. Unfortunately, there are several problems with the known techniques.

Because one sheet is processed at a time, throughput is compromised and productivity is limited. It would be desirable to increase the throughput of lites through a seaming process thereby increasing productivity. Also, the position of the glass at the seaming station needs to be carefully controlled. It would be desirable to have a system that can accommodate and process randomly positioned glass sheets at the seaming station. In addition, for a very large glass sheet, the time it takes to carry out the seaming process at least doubles. It would also be desirable to reduce the time it takes to seam large glass sheets.

In addition, particulates (e.g., chips, glass dust and/or particles) created during the seaming process can get imbedded within the grinding wheel's grooves which can limit the effectiveness of the grinding wheel as well as potentially damaging the glass sheet itself. It would be desirable to reduce the amount of debris exposed to the seaming head and glass sheet in order to increase its effectiveness and reduce defective product.

BRIEF DESCRIPTION OF THE DRAWINGS

The following drawings are illustrative of particular embodiments of the present invention and therefore do not limit the scope of the invention. The drawings are not necessarily to scale, and are intended for use in conjunction with the explanations in the following detailed description. Different embodiments of the invention will hereinafter be described in connection with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the invention. Examples of constructions, materials, dimensions, and manufacturing processes are provided for selected elements; all other elements employ that which is known to those of ordinary skill in the field of the invention. Those skilled in the present art will recognize that many of the noted examples have a variety of suitable alternatives.

Figure 1:
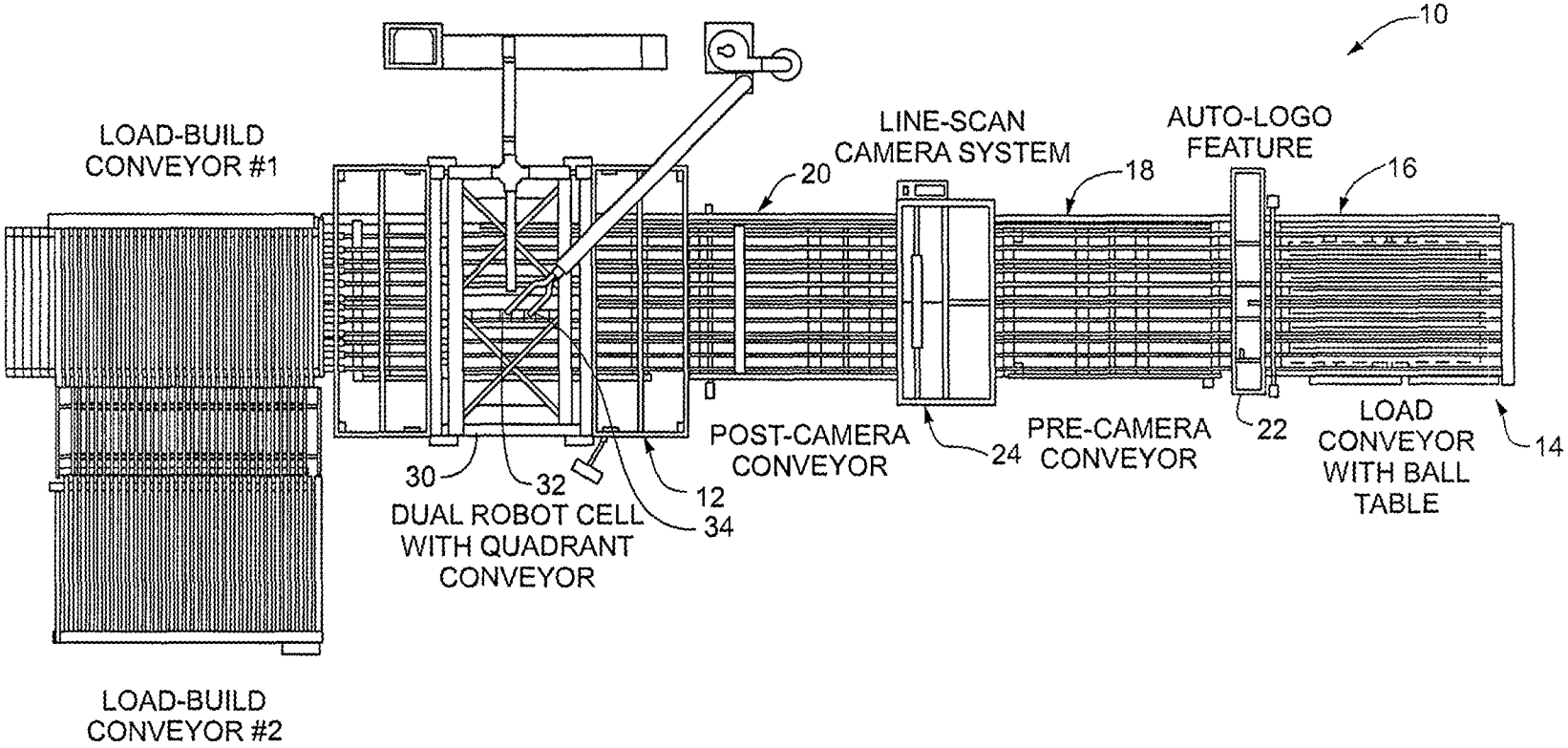
FIG. 1 illustrates a seaming assembly line according to a preferred embodiment of the invention.

FIG. 1 illustrates a seaming assembly line 10 according to a preferred embodiment of the invention. The assembly line 10 includes a seaming station 12, as well as pre-seaming stations 22, 24. It will be appreciated by those of ordinary skill in the art that the number of pre-seaming stations may be increased or eliminated and post-seaming stations may be incorporated into the assembly line as well and the embodiments of the invention are not limited in this regard. The assembly line incorporates a transport mechanism 14 that transports glass lites to the seaming station 12 preferably after undergoing some pre-seaming operations. The transport mechanism 14 may be a single conveyor system or it may be formed by multiple conveyor systems including a load conveyor 16, a pre-inspection conveyor 18 and a post-inspection conveyor 20. In a preferred embodiment, all or parts of the transport mechanism 14 may be a dual line conveyor including a first conveyor and a second conveyor parallel with each other and running side-by-side, as will be described in more detail hereafter. The dual line conveyor may form the load conveyor 16, the pre-inspection conveyor 18 and the post-inspection conveyor 20 or it may only form certain ones of the conveyors, 16, 18, 20. Each conveyor is preferably independently operable and controllable, although they need not be, and each is controlled by encoders and geared inverter drives and driven by servomotors for precise positioning. In the seaming station itself there is also a transport mechanism which will be described in greater detail hereinafter.

Figure 2:
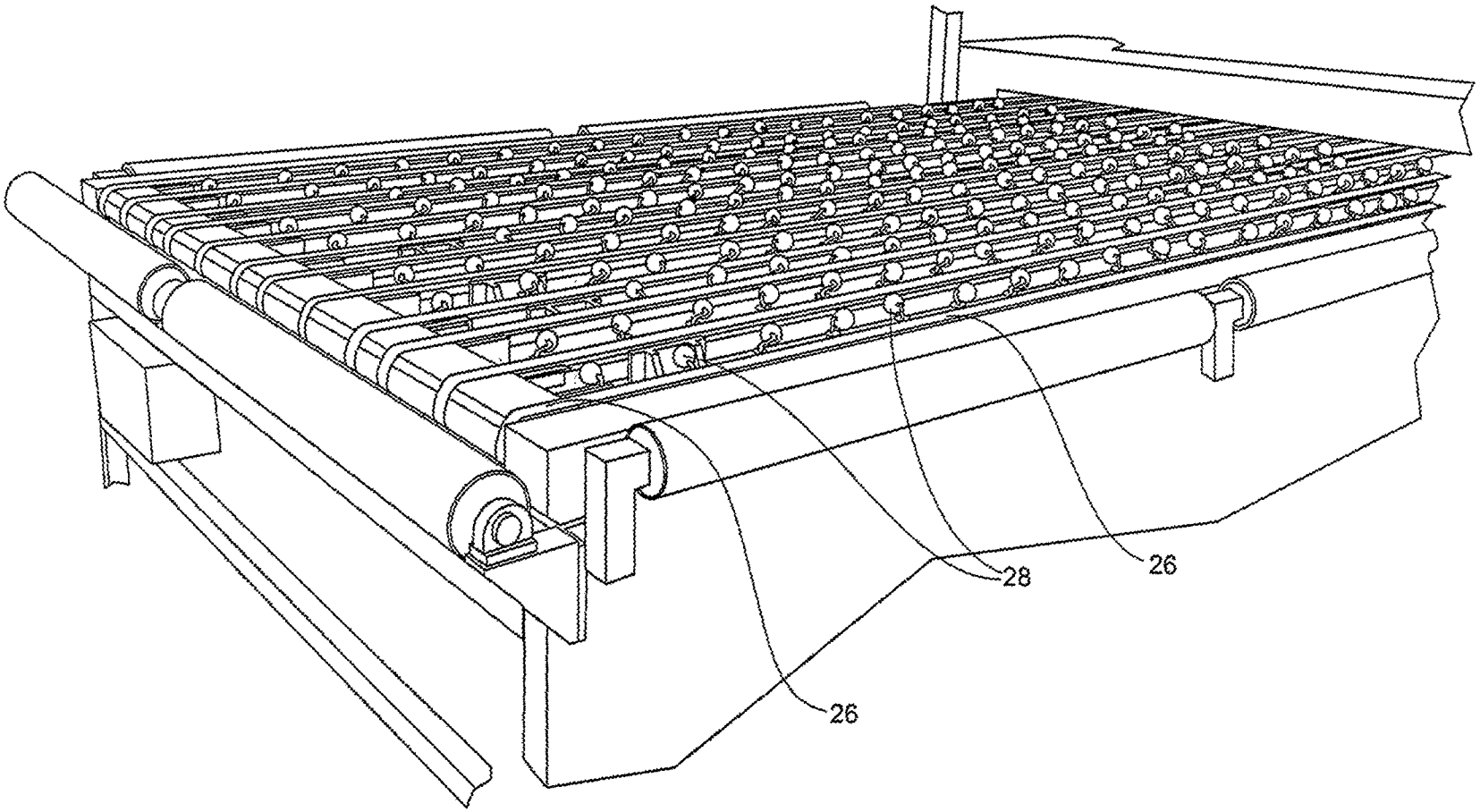
FIG. 2 is a perspective view of a load conveyer forming a part of the seaming assembly line.

FIG. 2 is a perspective view of a load conveyor 16 forming part of the seaming assembly line according to a preferred embodiment of the invention. Unfinished glass sheets are loaded onto the load conveyor 16. Preferably, the load conveyor includes a plurality of conveyor bands 26 that run between series of pop-up ball rollers 28 as is conventional in the glass processing industry. Referring back to FIG. 1, downstream of where the lites are loaded onto the load conveyor 16 is an optional auto-logo station 22 which can print a logo, such as a company's name, or ANSI tempering logo, on the lite passing underneath it. Of course other or additional types of information may be printed on the lite such as finished product designation. The logo is printed using a laser with a marking head as is well known. One such laser and marking head are commercially available from Synrad, Inc. of Washington state, i.e., the FSV30SFE laser with a FHFL 50-200 marking head. Preferably the laser and marking head are mounted on a gantry so that they can be moved along the width of the transport mechanism as needed.

Downstream of the optional auto-logo station 22 is an inspection station 24 that preferably has an in-line camera system (not shown) to plot the shape, size and position of each lite on the transport mechanism as it passes underneath the inspection system and this data is transformed to code which steers at least one of the robot arms during the seaming process. Preferably, the vision system for robot path generation is a Teledyne-Dalsa line scan camera with one red LED line light at a wavelength of 630 nm. The inspection system downloads the position and orientation information to a controller for controlling the operation of robot arms and associated seaming heads in the seaming station 12 as will be described in further detail hereinafter.

Downstream of the inspection station 24 is the seaming station 12 which will be described in greater detail hereinafter and, downstream of that, is a post-seaming transport which may deliver the seamed glass to post-processing stations such as a tempering oven, for example.

Figure 3:
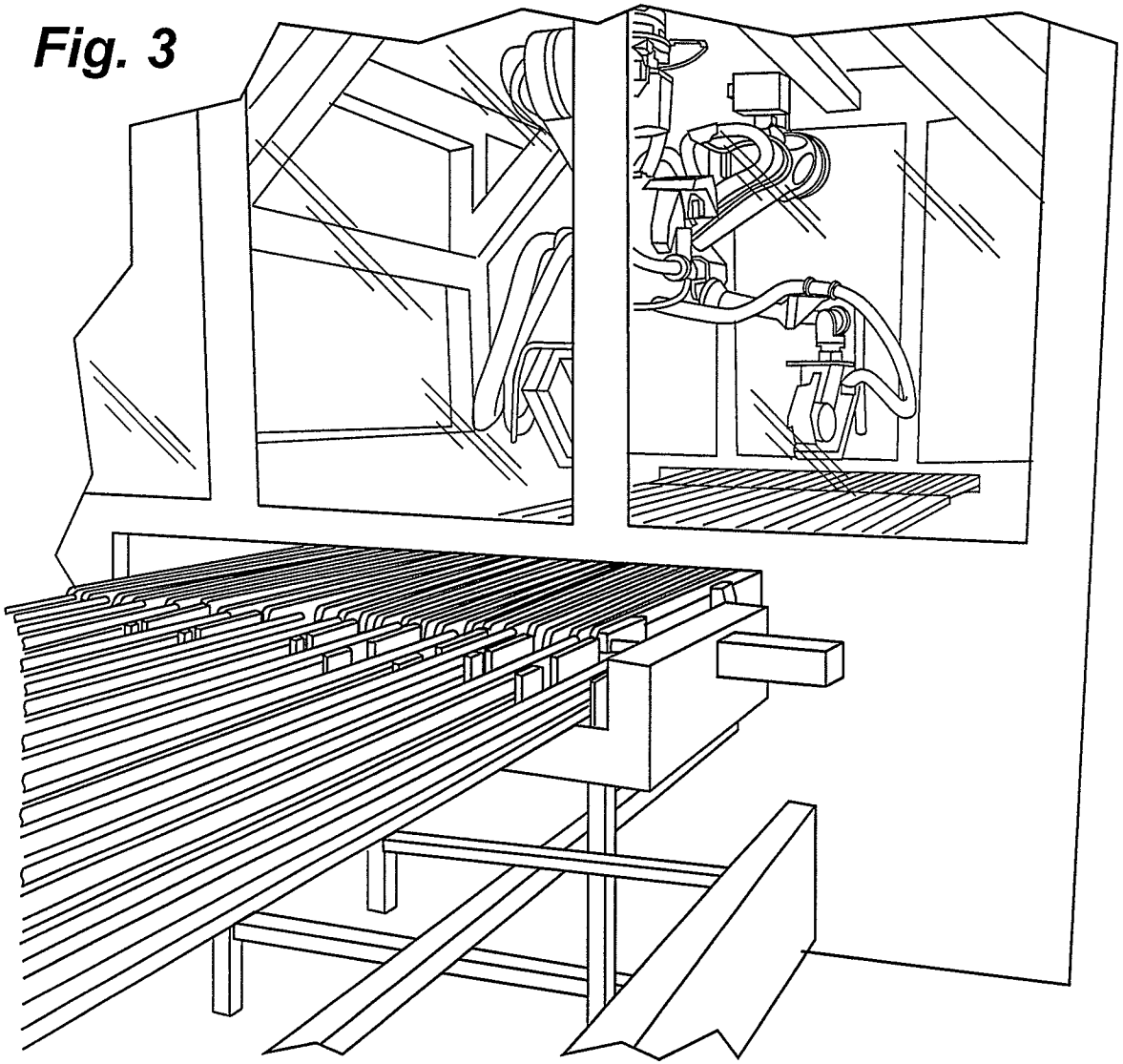
FIG. 3 illustrates a perspective view of the seaming station according to a preferred embodiment of the invention.

FIG. 3 illustrates a perspective view of a seaming station according to a preferred embodiment of the present invention. Details of the seaming station will now be described. The seaming station is preferably enclosed around its perimeter by a safety shield such as Plexiglas windows 29 to create a guarded, seaming zone. The lite or lites are transported through an opening 31 in the enclosure. Located within the enclosure, is a gantry 30 that straddles the transport mechanism. Suspended from the top of the gantry 30 are two robot arms 32, 34. Coupled to each free end of the robot arms 32, 34 is a seaming head 36, 38 (see FIG. 10) that process the edges of the lites which will be described in greater detail hereinafter. Preferably the robot arms have six axis of rotation. Such a robot arm is commercially available from Fanuc of Yamanashi, Japan under model number R-1000iA/80F, for example.

Figure 4:
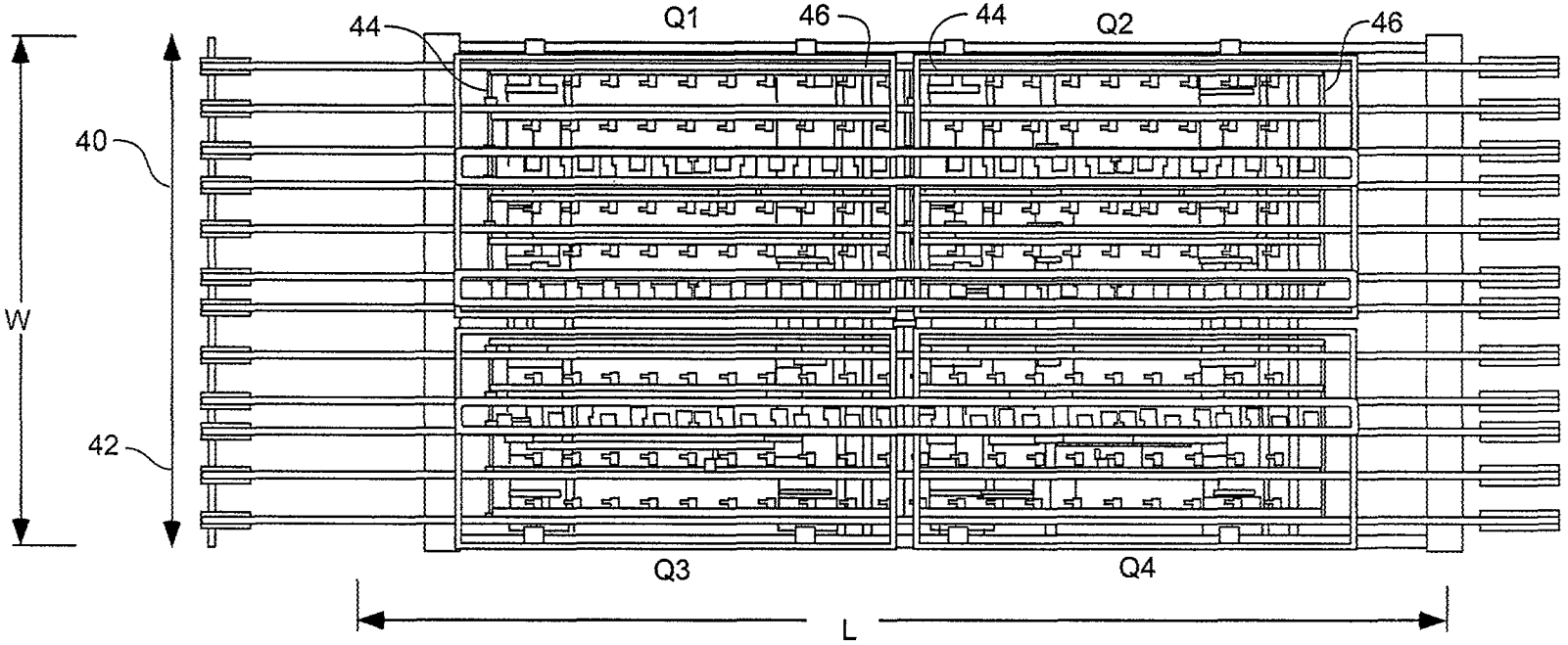
FIG. 4 illustrates an operational platform located in an enclosure of the seaming station.

FIG. 4 illustrates an operational platform located in the enclosure 29 of the seaming station 12. Preferably, it includes two, side-by-side transport mechanisms 40, 42, i.e., conveyors, that can be operated together to create a large transport mechanism that expands the entire width, w, of the seaming station or they can be operated separately from one another to form two individual transport mechanisms.

Figure 5:
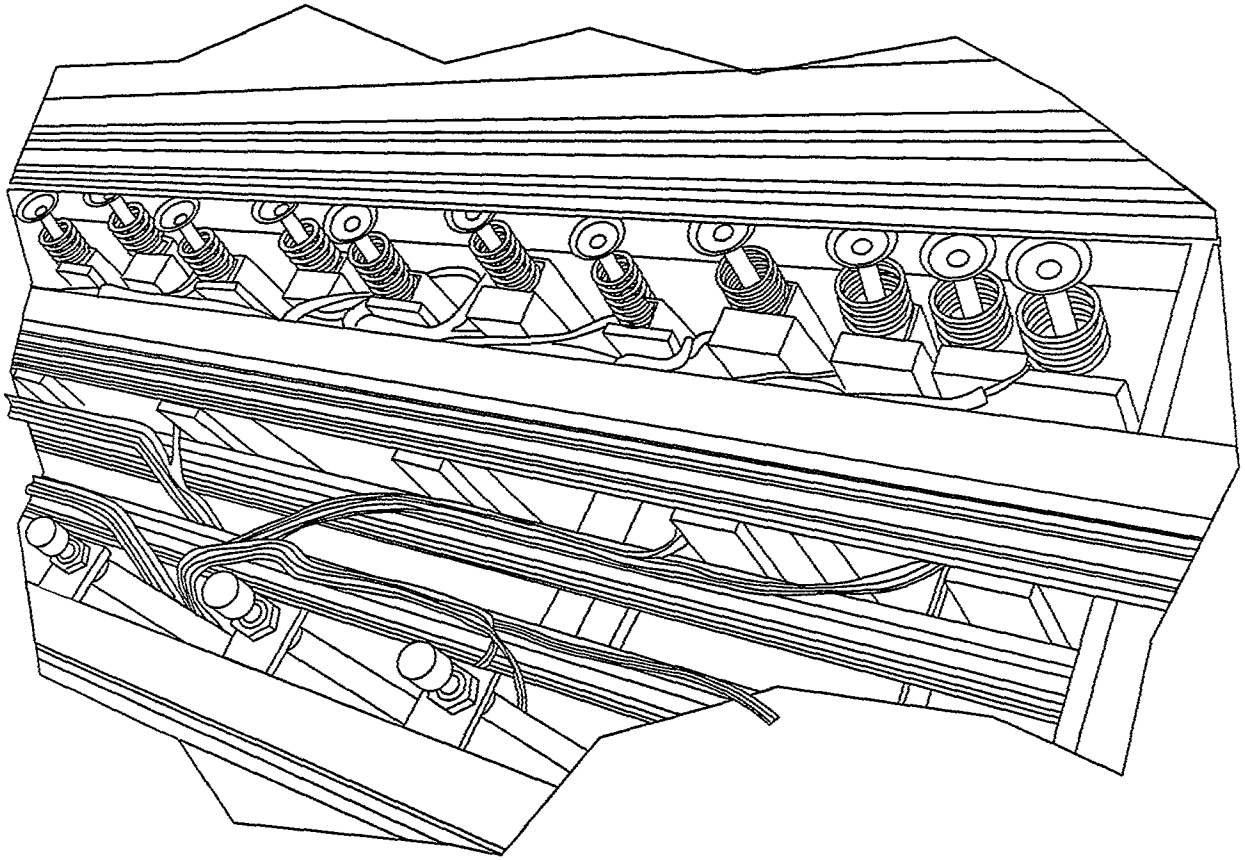
FIG. 5 illustrates a lifting device according to a preferred embodiment of the invention.

In the seaming station, the transport mechanism is divided preferably into four quadrants, Q1-Q4, as shown in FIG. 4. Each quadrant includes an entrance 44 and an exit 46 and a longitudinal axis, "l", coupling the entrance to the exit. Each quadrant also has a lifting device (see FIG. 5) initially located underneath the transport mechanism when the lifting device is deactivated. FIG. 5 illustrates a lifting device 50. The lifting device 50 includes a matrix of vacuum cups 52 and support pins 54 which can be raised above the transport mechanism when the lifting device 50 is activated so that a lite that is positioned thereover may be lifted above the transport mechanism so that it may be seamed by at least one of the seaming heads. Preferably, each quadrant have a total of 70 vacuum cups and 112 support pins. Preferably the lites are lifted about 8 inches above the transport mechanism. Before the lifting device 50 is fully raised, a vacuum source is applied to the vacuum cups 52 once they come into contact with the lite to keep the lite secured to the lifting device 50 during lifting operation as well as during seaming operation.

The division of the transport mechanism into quadrants allows for multiple and different sizes of lites to be processed simultaneously, sequentially, or both as will be described in detail hereinafter.

Figure 6:
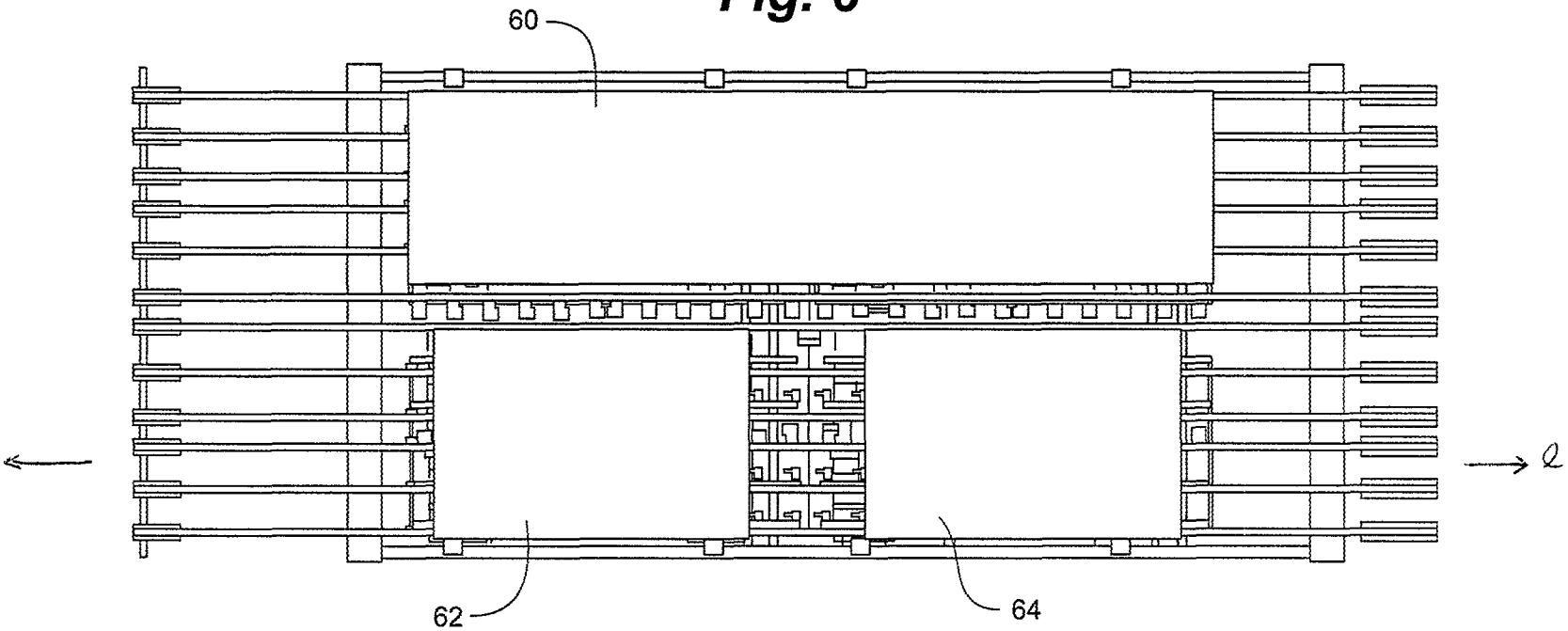
FIGS. 6 and 7 illustrate various processing scenarios possible at the seaming station.
Figure 7:
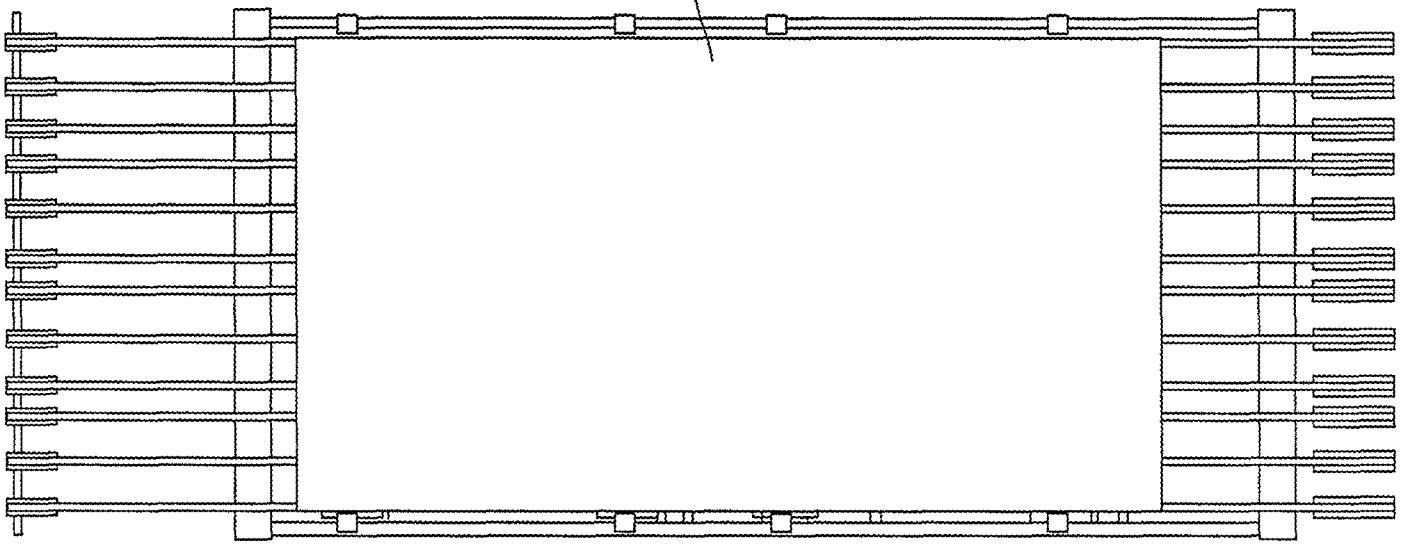

The following scenarios may present themselves at the four quadrants of the seaming station 12. FIGS. 6 and 7 illustrate examples of various processing scenarios possible at the seaming station.

FIG. 6 illustrates one scenario where a large lite 60 is located on quadrants one and two, Q1 and Q2, a smaller lite 62 is located on quadrant three Q3 and a smaller lite 64 is located on quadrant four Q4. While the lites shown on quadrants three and four are shown as the same size, they do not need to be. For the larger lite 60 located on quadrants one and two, the lifting devices in those quadrants are simultaneously activated to lift the lite 60 above the transport mechanism. The lite 60 can be either seamed by one of the seaming heads using one robot arm or it may be simultaneously seamed by both of the seaming heads to speed up the processing time. If one seaming head is used, its associated robot arm moves that seaming head 360 degrees around the perimeter of the lite. If two seaming heads are used, each robot arm moves its respective seaming head around half of the perimeter of the lite so that the entire perimeter is seamed. The lites 62, 64 on quadrants three and four may be conveyed into the seaming station at the same time as the larger lite 60 or they may be conveyed into the seaming station as the larger lite 60 is being seamed or after it has been seamed. While the larger lite 60 is being seamed, the lifting devices in quadrants three and four are not activated so the lites 62, 64 in those quadrants remain on the transport mechanism while the larger lite 60 is elevated above the transport mechanism.

Once the larger lite 60 has been seamed, it can be lowered and either remain on the transport mechanism or conveyed out of the seaming station 12. Depending on the separation distance between the two smaller lites 62 and 64, the lifting devices of the third and fourth quadrants will either lift the smaller lites simultaneously if the distance is great enough and one robot arm seaming head and its associated seaming head will be used to seam one lite while the other robot arm and its associated seaming head is used to seam the other lite. If there is not enough distance between the two lites 62 and 64, either quadrant three or four will lift its lite and use one robot arm to seam that lite and, once it is seamed, that lifting device is deactivate to lower the lite while the other lite is lifted by its associated lifting device. Once the smaller lites are seamed, they can be conveyed out together.

FIG. 7 illustrates a different scenario where a very large lite 66 presents itself at the seaming station. The large lite 66 is transported on both transport mechanisms and, in this particular case, occupies all four quadrants, Q1-Q4. The lifting devices of all the quadrants are activated to simultaneously lift the large lite above the transport mechanism so that it can be seamed. To seam this large lite, both robot arms are activated along with both seaming heads to seam the lite. Each seaming head seams a different 180 degrees around the perimeter of the lite. Once the lite is seamed, all of the lifting devices lower the lite back onto the transport mechanism so that it can be transported out of the seaming station.

Figure 9:
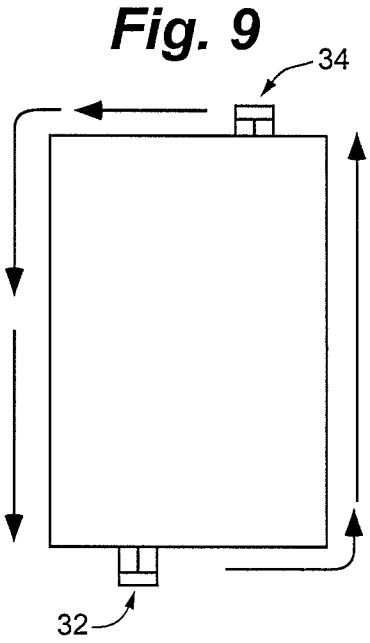
FIGS. 8 and 9 illustrate two scenarios of how the robot arm and their respective seaming head can operate.
Figure 8:
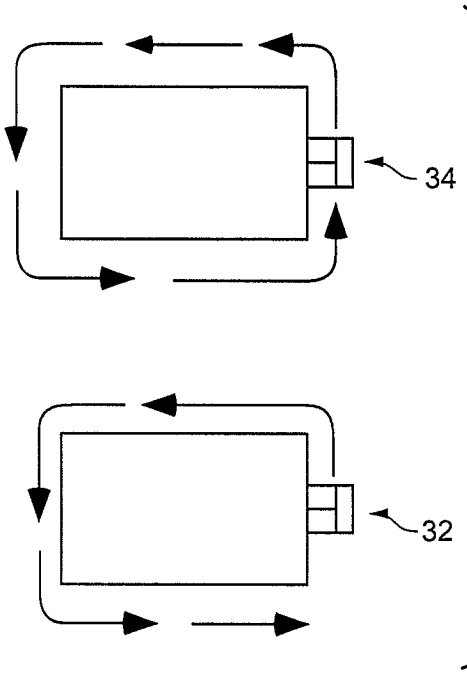

FIGS. 8 and 9 illustrate the two scenarios of how the robot arms (along with their respective seaming heads) can operate. In FIG. 8, two lites are present at the seaming station and each robot arm (along with its respective seaming head) is operated independently of one another to seam its own lite so that two lites are processed simultaneously assuming there is enough distance between the lites. In FIG. 9, one lite is present at the seaming station and both robot arms work on the lite simultaneously to seam different portions of the lite. Usually this is the case for a large lite. The large lite may occupy all four quadrants, Q1-Q4, of the seaming station as shown in FIG. 7, or it may occupy only two quadrants such as quadrants Q1 and Q2 or Q2 and Q4, for example. By providing the robot arms and seaming heads with the flexibility to operate independently of one another on separate lites or to operate in conjunction with one another on a single lite, the throughput of the seaming station is increased over known systems. After completing its pass, each robot arm returns to a parked position.

Figure 10:
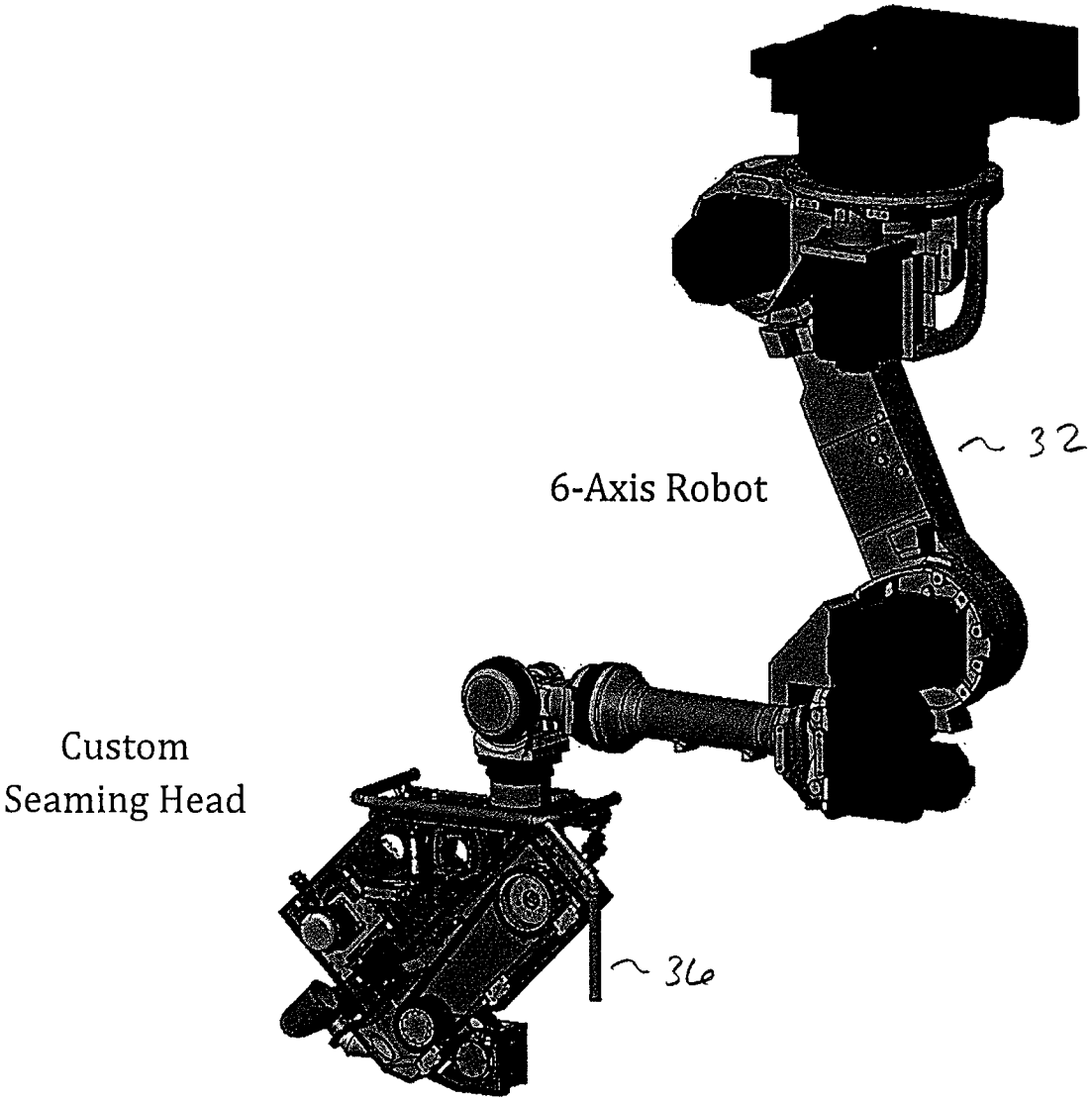
FIG. 10 is a perspective view of a robot arm with a seaming head coupled to its free end.

FIG. 10 is a perspective view of a robot arm 32 with a seaming head 36 coupled to its free end. The robot arm 32 is commercially available from Fanuc of Yamanishi, Japan as Model No. R-1000iA/80F. The robot arm preferably has six axis of rotation to allow it to move the seaming head around the perimeter edges of a lite.

Figure 11:
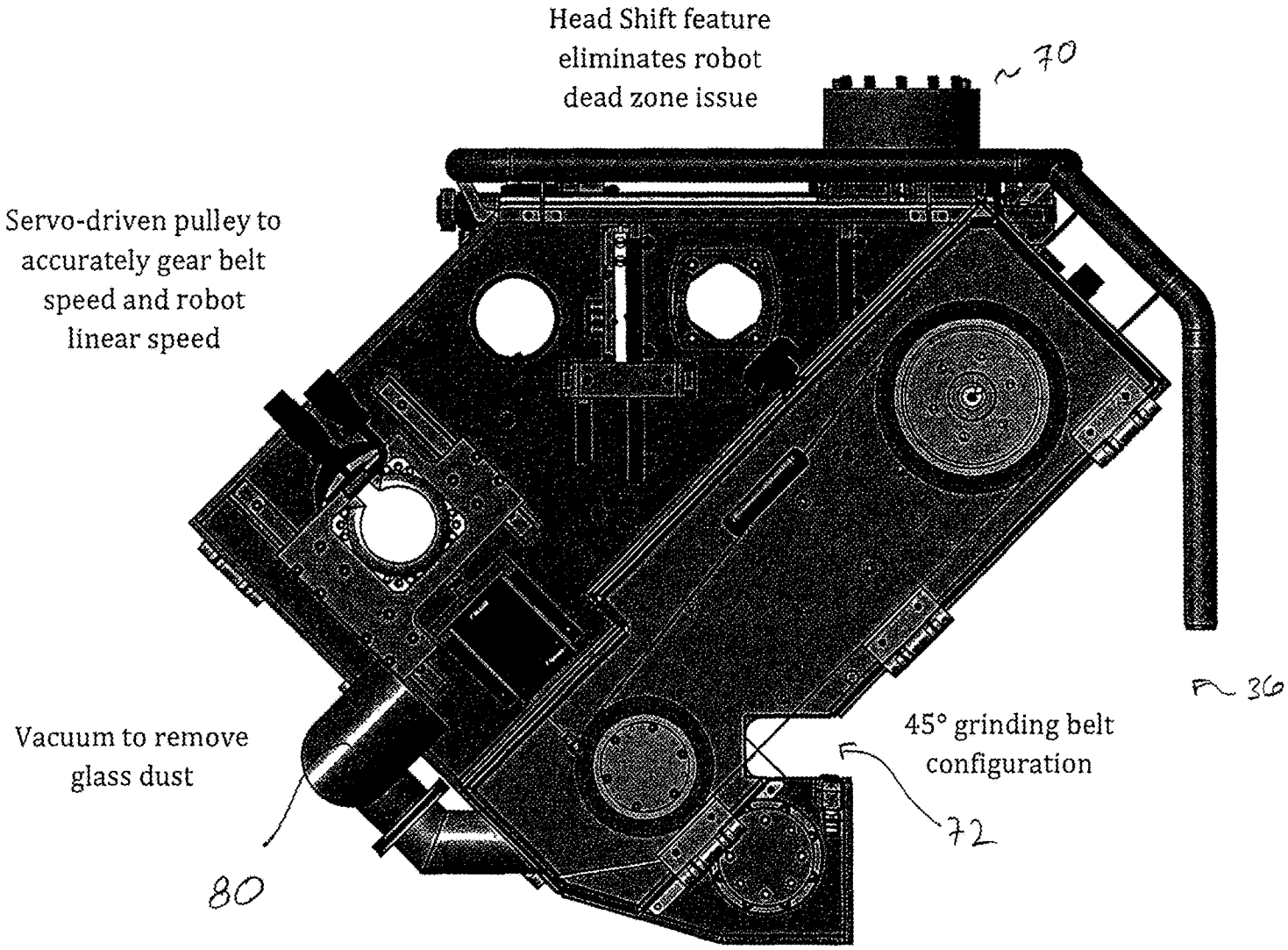
FIG. 11 is a schematic of a seaming head according to a preferred embodiment of the invention.

FIG. 11 is a schematic of a seaming head 36 according to a preferred embodiment of the invention that is attached to the free end of a robot arm at point 70. The seaming head has an aperture 72 that exposes a pair of abrasive belts (see FIGS. 74, 76, 12 and 13) each rotating around a pair of pulleys. The seaming head is positioned by the robot arm so that the edge of the lite is located in the aperture 72 so that the upper and lower edges of the lite are seamed by one of the respective belts, as the seaming head travels around the perimeter of the lite. A controller receives positioning information from the inspection system 24.

Figure 12:
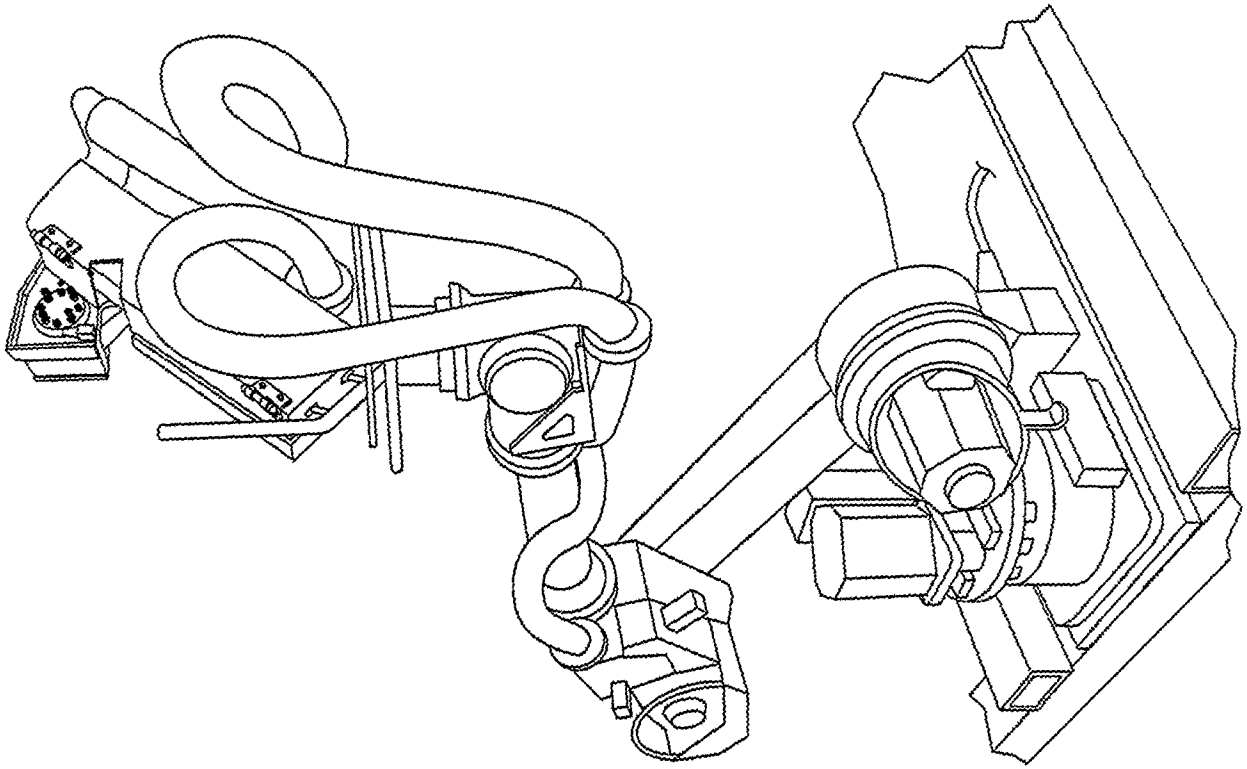
FIG. 12 is a photograph showing a perspective view of a seaming lead.
Figure 13:
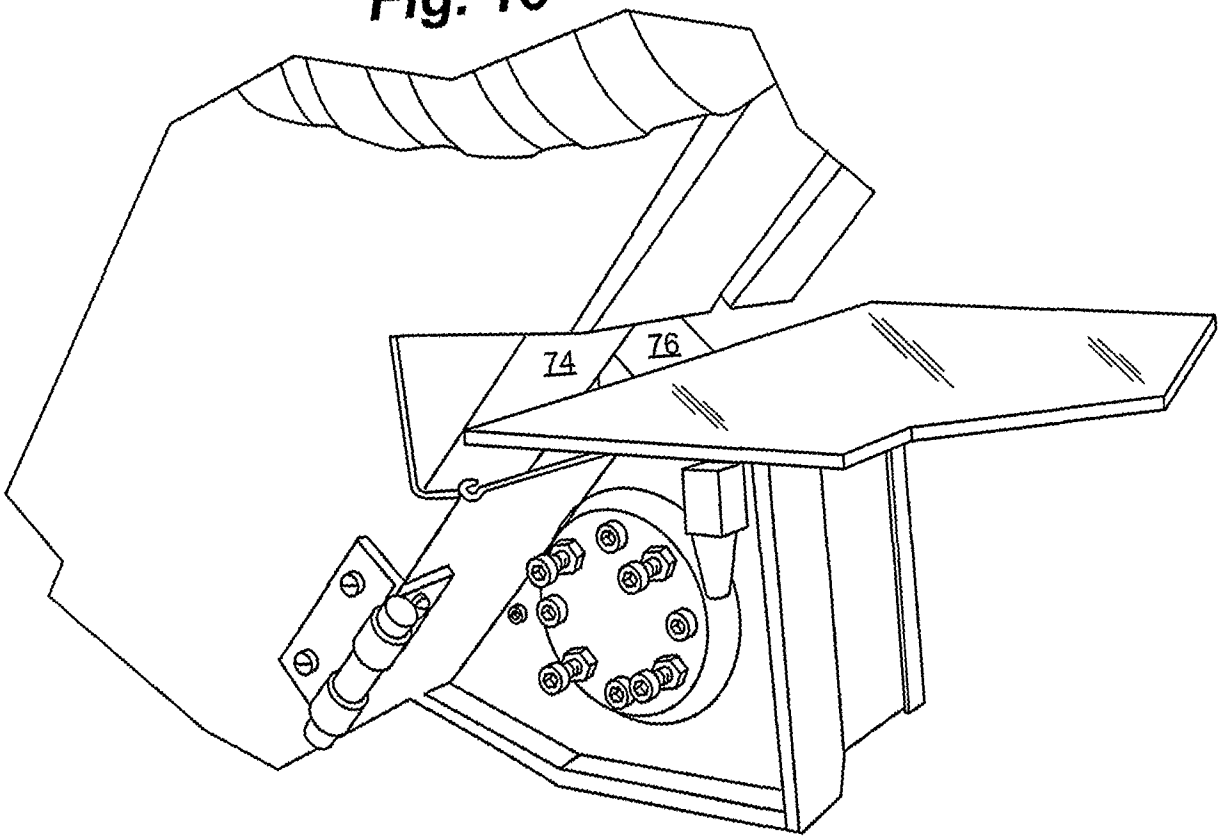
FIG. 13 is a photograph of the belts vis-à-vis an edge of a lite.

FIG. 12 is a photograph showing a perspective view of the seaming head showing the aperture 72 and the pair of belts 74 and 76. FIG. 13 is an expanded view of the grinding belts 74, 76 in the seaming head as viewed through the aperture 72. Each seaming head preferably has two grinding belts 74, 76 with each grinding belt revolving around a pair of pulleys. The belts are exposed in an aperture or window 72 of the seaming head. The grinding belts 74, 76 are arranged so that one belt 74 will grind an upper edge of a lite while the other belt 76 grinds a lower edge of the lite. As the seaming head passes around a perimeter of a lite, each belt will grind its respective portion of the lite's edge. FIG. 13 is a photograph of the belts vis-à-vis an edge of a lite. The belts may be made using either diamond or SIC silicone carbide/carborundum as is well known to those of ordinary skill in the art. One example of such a commercially available belt is Norton's Norex U466 belt. The seaming head may also be provided with water nozzles for wet seaming.

Each seaming head is also equipped with a vacuum port to couple the interior of the seaming head to a vacuum system. In particular, a port 80 as shown in FIG. 11 is located on the seaming head to which a vacuum hose may be coupled. When the seaming head is operational, the vacuum is activated so that debris created by the grinding belts grinding the lite are suctioned out of the seaming head. This helps maintain the integrity of the belts and quadrants below the seaming head.

While a preferred embodiment of the present invention has been described, it should be understood that various changes, adaptations and modifications may be made therein without departing from the spirit of the invention and the scope of the appended claims.

What is claimed is:

1. A seaming station for seaming edges of a lite comprising:

a first platform having an entrance and an exit and a first longitudinal axis coupling the entrance to the exit;

a second platform located adjacent to the first platform, the second platform having an entrance and an exit and a second longitudinal axis coupling the entrance to the exit wherein the second longitudinal axis is parallel to the first longitudinal axis;

a first robot arm suspended above at least one of the first and second platforms, the first robot arm having a free end with a first seaming head coupled thereto;

a second robot arm suspended above at least one of the first and second platform, the second robot arm having a free end with a second seaming head coupled thereto;

a processor operatively coupled to the first and second robot arms as well as the first and second seaming heads, the processor programmed to independently control the robot arms and seaming heads to perform both of the following functions:

move the first robot arm and associated seaming head independently of the second robot arm and associated seaming head so that each seaming head can simultaneously seam all edges of a unique workpiece located on its respective platform without changing the orientation of the workpiece on its respective platform or changing the orientation of the respective platform; and move the first robot arm and associated seaming head in conjunction with the second robot arm and associated seaming head to simultaneously seam all edges of one workpiece located on at least one of the platforms without changing the orientation of the workpiece on the at least one of the platforms or changing the orientation of the at least one platform, wherein the function performed by the first and second robot arms and their respective seaming heads is determined by the dimension of the workpiece located at the at least one of the platforms wherein the processor receives information from an optical system concerning the dimensions of the workpiece to be processed and selects the function dependent on the received information.

2. The seaming station according to claim 1 further comprising a lifting device associated with each platform that can be operated independently of one another or in conjunction with one another depending on the dimension and position of the lite being processed at the station wherein the lifting device lifts the lite or a portion of the lite above the respective platform when the lifting device is activated.

3. A seaming station according to claim 2 wherein the first platform is divided into a plurality of additional platforms and each additional platform has its own lifting device that can be independently operated.

4. A seaming station according to claim 3 wherein each lifting device comprises a matrix of suction cups arranged sequentially parallel to the longitudinal axes of the additional platforms wherein the matrix is located underneath the additional platforms when the lifting device is not activated and wherein the lifting devices raise the matrix of suction cups above the additional platforms when the lifting device is activated.

5. A seaming station according to claim 1 further comprising a conveyor system located at the first and second platforms for transporting a lite from the entrance end of the first and second platform to the exit end of the first and second platform.

6. A seaming station according to claim 1 where in each of the first and second robot arms has six axis of rotation.

7. A seaming station according to claim 1 wherein each of the first and second seaming heads includes a vacuum port coupled to a vacuum system for aspirating debris from the seaming head when the seaming head is operating.

8. A seaming station according to claim 1 further comprising a transport mechanism for transporting a seamed lite to the station and transporting a seamed lite from the station.

9. A seaming station according to claim 1 further comprising a gantry straddling the first and second platforms from which the first and second robot arms are suspended.

10. A seaming station according to claim 9 further comprising an enclosure for enclosing a perimeter of the seaming station.

11. A seaming station according to claim 1, wherein the processor receives information from a scanner located upstream of the station concerning the dimensions and position of each lite that will be input to the seaming station and outputs data to each robot arm that guides the robot arm and associated seaming head around the lite during a seaming process.

12. A seaming station according to claim 1 wherein each seaming head comprises:

a first pair of pulleys rotatably mounted on a support frame and driven by a motor;

a second pair of pulleys rotatably mounted to the support frame and driven by the motor;

a first belt engaged to and driven by the first pair of pulleys;

a second belt engaged to and driven by a second pair of pulleys; and an aperture for exposing a portion of the first and second belts, wherein the first and second belts contact opposite edges of the lite to seam the edges.

13. A seaming station according to claim 12 wherein the first and second belts are made of abrasive material and abrade the opposite edges of the lite.

14. A seaming station for seaming edges of at least one workpiece, the station comprising:

a first robot arm suspended above a platform, the first robot arm having a first seaming head coupled thereto;

a second robot arm suspended above the platform, the second robot arm having a second seaming head coupled thereto;

a processor operatively coupled to the first and second robot arms as well as the first and second seaming heads, the processor programmed to independently control the robot arms and seaming heads to perform both of the following functions:

move the first robot arm and associated seaming head independently of the second robot arm and associated seaming head to each simultaneously seam all edges of different workpieces located at different positions on the platform without changing the orientation of the workpiece on the platform or changing the orientation of the platform; and move the first robot arm and associated seaming head in conjunction with the second robot arm and associated seaming head to simultaneously seam edges of one workpiece located on the platform without changing the orientation of the workpiece on its respective platform or changing the orientation of the respective platform.

15. A seaming station according to claim 14 where in each of the first and second robot arms has six axis of rotation.

16. A seaming station according to claim 14 wherein each of the first and second seaming heads includes a vacuum port coupled to a vacuum system for aspirating debris from the seaming head when the seaming head is operating.

17. A method for seaming edges of at least one workpiece comprising:

delivering a workpiece to a seaming station having a first robot arm suspended above a platform, the first robot arm having a first seaming head coupled thereto; a second robot arm suspended above the platform, the second robot arm having a second seaming head coupled thereto;

transmitting positional and dimensional information about the workpiece from an optical system;

independently controlling the robot arms and seaming heads to perform both of the following functions:

each seaming head independently seam all edges of a distinct lite located on the platform; and each seaming head, in conjunction with one another, simultaneously seam all edges of a single lite located on the platform without changing the orientation of the workpiece on its respective platform or changing the orientation of the respective platform.

* * * * *